US005961003A

United States Patent [19]

Coryell

[11] Patent Number: 5,961,003

[45] Date of Patent: Oct. 5, 1999

[54] PERSONAL DEFENSE SPRAYER DEVICE

[76] Inventor: Gloria M. Coryell, 555 Breakneck Rd., Mullica Hill, N.J. 08062

[21] Appl. No.: 09/048,672

[22] Filed: Mar. 26, 1998

[51] Int. Cl.[6] ..... B67D 5/64

[52] U.S. Cl. ..... 222/175

[58] Field of Search ..... 222/175, 78, 79, 222/192, 402.1; 2/160, 161.1

[56] References Cited

U.S. PATENT DOCUMENTS

| | | | |
|---|---|---|---|
| 4,463,879 | 8/1984 | Des Voignes | 222/175 |
| 4,997,110 | 3/1991 | Swenson | 222/175 |
| 5,072,856 | 12/1991 | Kimble | 222/175 X |
| 5,088,121 | 2/1992 | Wallace | 222/175 X |
| 5,111,968 | 5/1992 | Wilkerson | 222/175 X |
| 5,484,085 | 1/1996 | Bennett | 222/175 |
| 5,538,164 | 7/1996 | Rivas | 222/175 X |
| 5,607,090 | 3/1997 | Brown | 222/175 X |
| 5,678,730 | 10/1997 | Fabek et al. | 222/175 X |

*Primary Examiner*—Kevin P. Shaver

[57] ABSTRACT

A new personal defense sprayer device for projecting a spray of chemicals. The inventive device includes a container designed for holding a chemical defense liquid within its interior with a spray actuator in fluid communication with the interior of the container. An actuator strap and a wrist attachment member function as an attachment means for attaching the personal defense sprayer device to a hand such that the spray actuator is actuated to project a spray of the chemical defense liquid when the hand is unclenched and the back of the hand is flexed back towards the forearm.

8 Claims, 3 Drawing Sheets

PERSONAL DEFENSE SPRAYER DEVICE

BACKGROUND OF THE INVENTION

1. Field of the Invention

The present invention relates to personal defense devices and more particularly pertains to a new personal defense sprayer device for projecting a spray of chemicals.

2. Description of the Prior Art

The use of personal defense devices is known in the prior art. More specifically, personal defense devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art personal defense devices include U.S. Pat. No. 5,289,164; U.S. Pat. No. 5,332,119; U.S. Pat. No. 4,135,645; U.S. Pat. No. 4,186,851; U.S. Pat. No. 4,223,804; and U.S. Pat. No. Des. 360,674.

While these devices fulfill their respective, particular objectives and requirements, the aforementioned patents do not disclose a new personal defense sprayer device. The inventive device includes a container designed for holding a chemical defense liquid within its interior with a spray actuator in fluid communication with the interior of the container. An actuator strap and a wrist attachment member function as an attachment means for attaching the personal defense sprayer device to a hand such that the spray actuator is actuated to project a spray of the chemical defense liquid when the hand is unclenched and the back of the hand is flexed back towards the forearm.

In these respects, the personal defense sprayer device according to the present invention substantially departs from the conventional concepts and designs of the prior art, and in so doing provides an apparatus primarily developed for the purpose of projecting a spray of chemicals.

SUMMARY OF THE INVENTION

In view of the foregoing disadvantages inherent in the known types of personal defense devices now present in the prior art, the present invention provides a new personal defense sprayer device construction wherein the same can be utilized for projecting a spray of chemicals.

The general purpose of the present invention, which will be described subsequently in greater detail, is to provide a new personal defense sprayer device apparatus and method which has many of the advantages of the personal defense devices mentioned heretofore and many novel features that result in a new personal defense sprayer device which is not anticipated, rendered obvious, suggested, or even implied by any of the prior art personal defense devices, either alone or in any combination thereof.

To attain this, the present invention generally comprises a container designed for holding a chemical defense liquid within its interior with a spray actuator in fluid communication with the interior of the container. An actuator strap and a wrist attachment member function as an attachment means for attaching the personal defense sprayer device to a hand such that the spray actuator is actuated to project a spray of the chemical defense liquid when the hand is unclenched and the back of the hand is flexed back towards the forearm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new personal defense sprayer device apparatus and method which has many of the advantages of the personal defense devices mentioned heretofore and many novel features that result in a new personal defense sprayer device which is not anticipated, rendered obvious, suggested, or even implied by any of the prior art personal defense devices, either alone or in any combination thereof.

It is another object of the present invention to provide a new personal defense sprayer device which may be easily and efficiently manufactured and marketed.

It is a further object of the present invention to provide a new personal defense sprayer device which is of a durable and reliable construction.

An even further object of the present invention is to provide a new personal defense sprayer device which is susceptible of a low cost of manufacture with regard to both materials and labor, and which accordingly is then susceptible of low prices of sale to the consuming public, thereby making such personal defense sprayer device economically available to the buying public.

Still yet another object of the present invention is to provide a new personal defense sprayer device which provides in the apparatuses and methods of the prior art some of the advantages thereof, while simultaneously overcoming some of the disadvantages normally associated therewith.

Still another object of the present invention is to provide a new personal defense sprayer device for projecting a spray of chemicals.

Yet another object of the present invention is to provide a new personal defense sprayer device which includes a container designed for holding a chemical defense liquid within its interior with a spray actuator in fluid communication with the interior of the container. An actuator strap and a wrist attachment member function as an attachment means for attaching the personal defense sprayer device to a hand such that the spray actuator is actuated to project a spray of the chemical defense liquid when the hand is unclenched and the back of the hand is flexed back towards the forearm.

Still yet another object of the present invention is to provide a new personal defense sprayer device that is mountable to a user's palm so that the user may actuate the sprayer by holding the palm straight and flexing back the wrist.

Even still another object of the present invention is to provide a new personal defense sprayer device that allows a user to carry a personal defense sprayer device in their clenched palm yet readily permit spraying of the defense spray merely by the user extending the hand into a "halt" position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
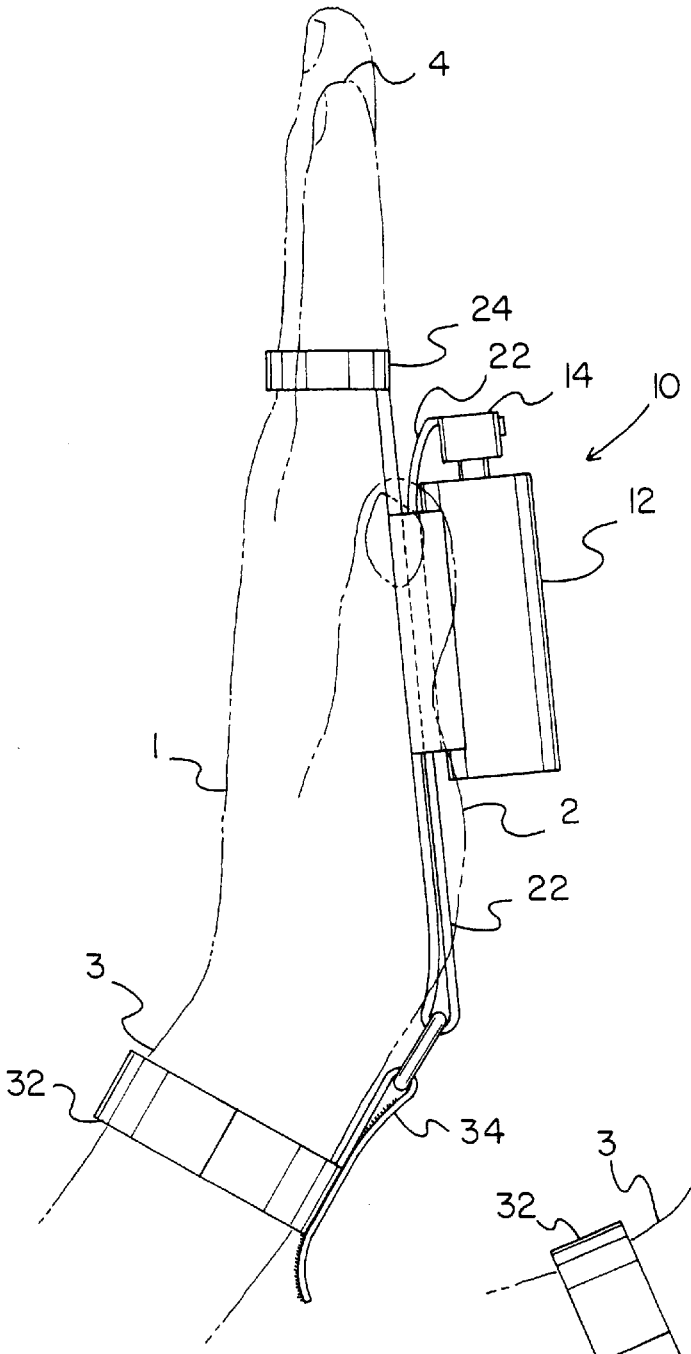
FIG. 1 is a schematic side view of a new personal defense sprayer device according to the present invention.
Figure 2:
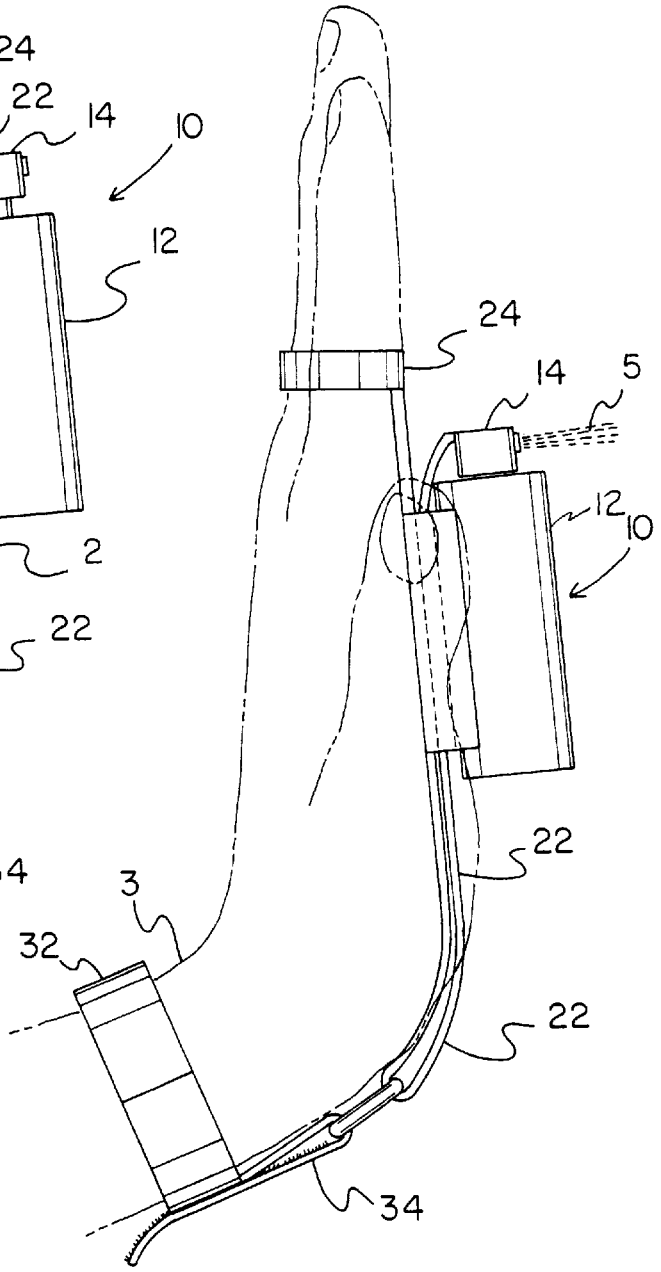
FIG. 2 is a schematic side view of the present invention with the hand flexed back to cause the actuation of the spray actuator.

With reference now to the drawings, and in particular to FIGS. 1 through 5 thereof, a new personal defense sprayer device embodying the principles and concepts of the present invention and generally designated by the reference numeral 10 will be described.

As best illustrated in FIGS. 1 through 5, the personal defense sprayer device 10 generally comprises a container 12 designed for holding a chemical defense liquid 5 within its interior with a spray actuator 14 in fluid communication with the interior of the container 12. An actuator strap 22 and a wrist attachment member 30 function as an attachment means for attaching the personal defense sprayer device 10 to a hand 1 such that the spray actuator 14 is actuated to project a spray of the chemical defense liquid 5 when the hand 1 is unclenched and the back of the hand is flexed back towards the forearm 3.

The actuator strap 22 is preferably elongated and flexible. At one end of the actuator strap 22 is a finger attachment ring 24 designed for insertion of a finger 4 to help hold the personal defense sprayer device 10 to the palm 2. The actuator strap 22 is looped and inserted through a mounting bore 13 in the container 12 so that the other end of the actuator strap 22 is coupled to the spray actuator 14 and looped about a looping ring 26.

Figure 3:
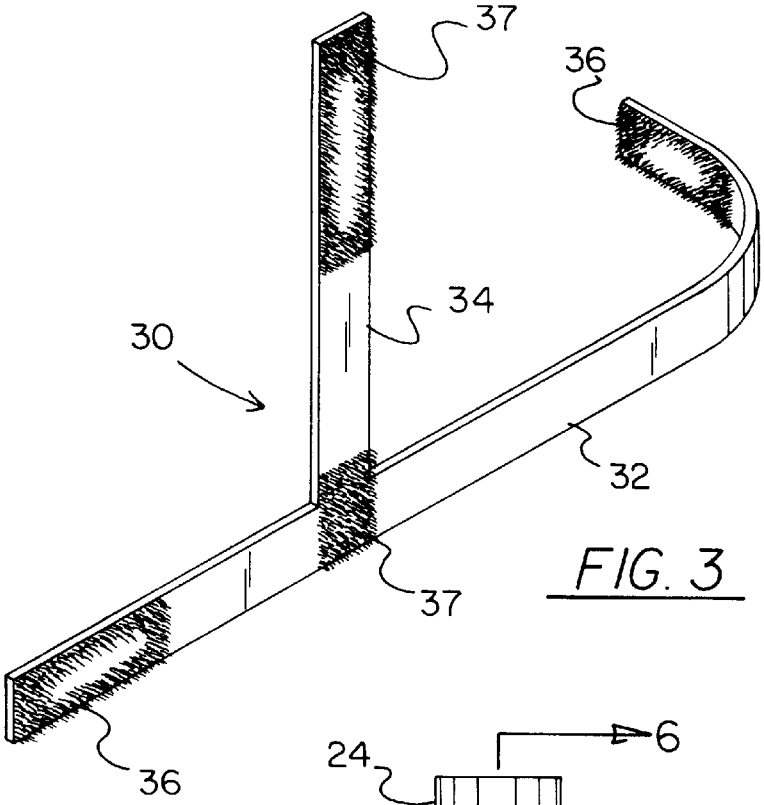
FIG. 3 is a schematic perspective view of the wrist attachment member of the present invention.
Figure 4:
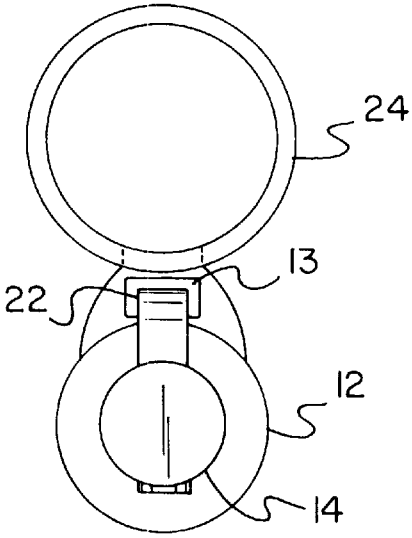
FIG. 4 is a schematic top view of the container and spray actuator of the present invention.
Figure 5:
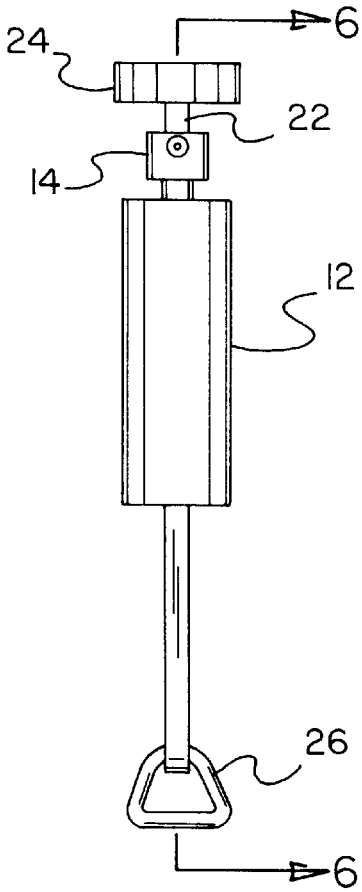
FIG. 5 is a schematic side view of the container and spray actuator of the present invention.
Figure 6:
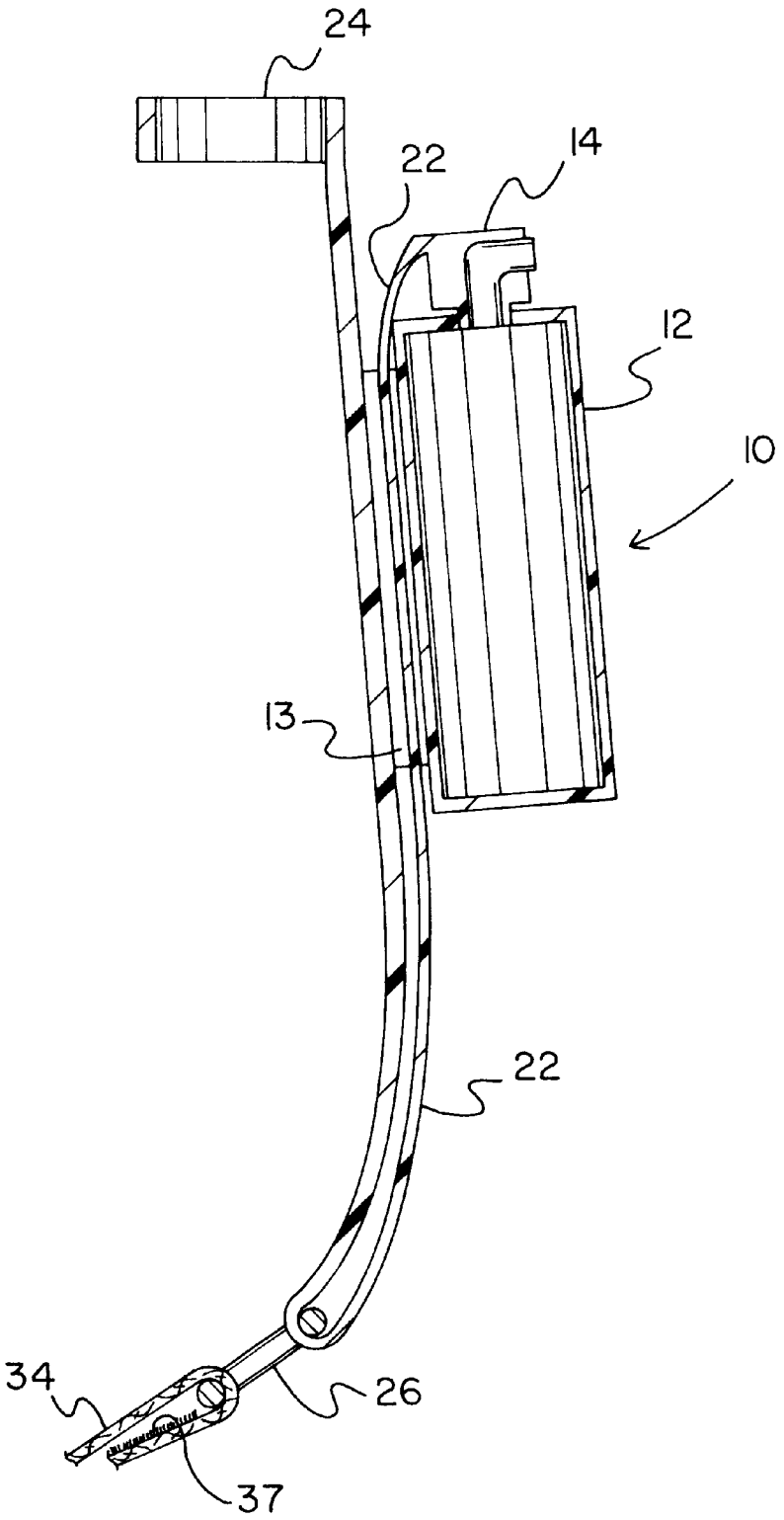
FIG. 6 is a cross-sectional view of the container and spray actuator of the present invention.

The wrist attachment member 30 includes a flexible elongate wrist strap 32 and a flexible elongate pulling strap 34. The wrist strap is designed for looping about a wrist 3 and coupling its ends together to secure the wrist strap 32 on the wrist 3. As shown in FIG. 3, the ends of the wrist strap 32 are preferably detachably attachable to each other, ideally by means of a hook and loop fastener 36.

One end of the pulling strap 34 extends substantially perpendicular from the wrist strap 32. This end of the pulling strap 34 is detachably attachable to the other end of the pulling strap 34, ideally by means of a hook and loop fastener 37. This arrangement permits the looping of the pulling strap 34 around the looping ring 26 to connect the pulling strap 34 to the actuator strap 22.

The spray actuator 14 is designed for projecting a spray of a liquid held within the container 12 when actuated. Preferably, the spray actuator 14 is mounted to the container 12 and in fluid communication with the interior of the container.

In use, the invention 10 is attached to a hand 1 so that the container 12 and spray actuator 14 are positioned on the palm 2. This permits concealment of the container 12 and spray actuator 14 when the hand is clenched. To use the invention 10, the hand is unclenched so that the palm 2 is exposed. The hand is flexed so that the back of the hand is moved towards the forearm 3 in a stop or halt position. This action causes the pulling of the actuator strap 22 which causes the actuation of the spray actuator 14 to project a spray of the liquid from within the container 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A personal defense sprayer device, for attachment to the palm of a hand, comprising:

a container for holding a liquid therein;

a spray actuator being in fluid communication with the interior of said container, said spray actuator being for projecting a spray of a liquid held within said container when actuated; and attachment means for attaching said container to the palm of a hand;

wherein said attachment means comprises an actuator strap coupled to said spray actuator and being adapted for coupling to a wrist in a manner such that said actuator strap actuates said spray actuator when the hand is unclenched and the back of the hand is flexed back towards the forearm.

2. The personal defense sprayer device of claim 1, wherein said container has a mounting bore, and wherein said actuator strap is elongate and has a first end and a second end, said first end of said actuator strap having a finger attachment ring for insertion of a finger therethrough, said second end of said actuator strap being coupled to said spray actuator, said actuator strap being inserted through said mounting bore.

3. The personal defense sprayer device of claim 2, wherein said attachment means further includes a wrist attachment member having a flexible elongate wrist strap and a flexible elongate pulling strap, said wrist strap having a first end and a second end, said wrist strap being for looping about a wrist, said wrist strap first end being detachably attachable to said wrist strap second end, said pulling strap being coupled to said wrist strap, said pulling strap being coupled to said actuator strap.

4. The personal defense sprayer device of claim 3, wherein said attachment means further includes a looping ring, and wherein said actuator strap being looped about said looping ring, and wherein said pulling strap having a pulling strap first end and a pulling strap second end, said pulling strap first end being coupled to said wrist strap, said pulling strap second end being extended from said wrist strap, said pulling strap being looped around said looping ring, said pulling strap second end being detachably coupled to said pulling strap first end.

5. The personal defense sprayer device of claim 4, wherein said pulling strap second end being detachably coupled to said pulling strap first end by a hook and loop fastener.

6. The personal defense sprayer device of claim 3, wherein said wrist strap first end being detachably attachable to said wrist strap second end by a hook and loop fastener.

7. The personal defense sprayer device of claim 1, wherein said spray actuator is slidably mounted to said container.

8. A personal defense sprayer device, for attachment to the palm of a hand, comprising:

a container for holding a defense chemical liquid therein, said container having a mounting bore;

a spray actuator mounted to said container and being in fluid communication with the interior of said container, said spray actuator being for projecting a spray of a liquid held within said container when actuated;

an elongate actuator strap having a first end and a second end, said first end of said actuator strap having a finger attachment ring for insertion of a finger therethrough, said second end of said actuator strap being coupled to said spray actuator, said actuator strap being inserted through said mounting bore;

a looping ring, said actuator strap being looped about said looping ring;

a wrist attachment member having a flexible elongate wrist strap and a flexible elongate pulling strap, said wrist strap having a first end and a second end, said wrist strap being for looping about a wrist, said wrist strap first end being detachably attachable to said wrist strap second end by a hook and loop fastener, said pulling strap having a pulling strap first end and a pulling strap second end, said pulling strap first end being coupled to said wrist strap, said pulling strap second end being extended from said wrist strap, said pulling strap being looped around said looping ring, said pulling strap second end being detachably coupled to said pulling strap first end by a hook and loop fastener; and wherein said actuator strap actuating said spray actuator when the hand is unclenched and the back of the hand is flexed back towards the forearm.

* * * * *